US011644017B2

(12) United States Patent
Wen et al.

(10) Patent No.: US 11,644,017 B2
(45) Date of Patent: May 9, 2023

(54) SWASHPLATE-TYPE AXIAL PLUNGER PUMP WITH MULTI-CHANNEL OIL FEED AND FULL-FLOW SELF-COOLING AND DOUBLE-END-FACE FLOW DISTRIBUTION

(71) Applicant: Yanshan University, Qinhuangdao (CN)

(72) Inventors: Desheng Wen, Qinhuangdao (CN); Jia Wen, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 303 days.

(21) Appl. No.: 17/130,053

(22) Filed: Dec. 22, 2020

(65) Prior Publication Data

US 2021/0199098 A1 Jul. 1, 2021

(30) Foreign Application Priority Data

Dec. 27, 2019 (CN) ..... 2019113747735

(51) Int. Cl.

| | |
|---|---|
| ***F04B 1/122*** | (2020.01) |
| ***F04B 1/146*** | (2020.01) |
| ***F04B 53/08*** | (2006.01) |
| ***F04B 53/18*** | (2006.01) |

(52) U.S. Cl.

CPC ..... *F04B 1/122* (2013.01); *F04B 1/146* (2013.01); *F04B 53/08* (2013.01); *F04B 53/18* (2013.01)

(58) Field of Classification Search

CPC ..... F04B 1/122; F04B 1/146; F04B 53/08

See application file for complete search history.

(56) References Cited

U.S. PATENT DOCUMENTS

| | | | | |
|---|---|---|---|---|
| 8,419,381 | B2 * | 4/2013 | Ito | F03C 1/0639 91/499 |
| 8,734,127 | B2 * | 5/2014 | Iida | F04B 1/188 91/499 |
| 9,410,540 | B2 * | 8/2016 | Mizoguchi | F04B 53/18 |

* cited by examiner

*Primary Examiner* — Michael Leslie

(74) *Attorney, Agent, or Firm* — IPro, PLLC

(57) ABSTRACT

The present disclosure discloses a swashplate-type axial plunger pump with multi-channel oil feed and full-flow self-cooling and double-end-face flow distribution. The cooling oil suctioned by the plunger pump firstly cools the friction pair of the cylinder block and the plunger; then, one part of the cooling oil passes through a gap between the pump case and the cylinder block and enters the control chamber by passing by the friction pair of the oil distribution plate and the cylinder block to cool the friction pair of the oil distribution plate and the cylinder block; and the other part of the cooling oil passes through a gap between the pump case and the cylinder block and enters the control chamber by passing by the friction pair of the slipper and the swashplate to cool the friction pair of the slipper and the swashplate.

8 Claims, 15 Drawing Sheets

A-A

SWASHPLATE-TYPE AXIAL PLUNGER PUMP WITH MULTI-CHANNEL OIL FEED AND FULL-FLOW SELF-COOLING AND DOUBLE-END-FACE FLOW DISTRIBUTION

TECHNICAL FIELD

The present disclosure relates to the technical field of plunger pumps, in particular to a swashplate-type axial plunger pump with multi-channel oil feed and full-flow self-cooling and double-end-face flow distribution.

BACKGROUND TECHNOLOGY

The swashplate-type axial plunger pump has the advantages of simple structure, high pressure, convenient variables and the like. It is widely used in hydraulic transmission in various industries. When the pump is working under medium and high pressure conditions, the hydraulic oil leaked from the three pairs of friction pairs in the plunger pump, that is, the plunger and the cylinder block, the swashplate and the slipper, and the oil distribution plate and the cylinder block, is called leakage return oil, which is led back to the oil tank by a leakage oil return pipeline. This part of the hydraulic oil drops from high pressure to low pressure, the product of the pressure and the amount of leaked oil is the hydraulic power loss of the leaked oil of the hydraulic pump. These power losses are reflected in the total leakage flow in the form of temperature, which causes the temperature of the leaked oil to rise sharply and become high-temperature oil. The high-temperature hot oil completely surrounds the outside of the three friction pairs, causing uneven deformation of the components of the three friction pairs, increasing abrasion, and greatly reducing the actual service life of the pump. In addition, the cylinder block drives the plunger and the slipper to rotate at a high speed to generate the self-stirring heat by directly stirring this part of the liquid, which further raises the temperature of this part of the liquid. Therefore, the damage to the internal parts of the pump is further aggravated, for example, the liquid flowing condition in the swashplate-type axial plunger pump is shown in FIG. 1.

The double-end-face flow distribution axial plunger pump (Chinese patent number 85103289.3) applied by the inventor was patented in 1985. The invention forms partial self-cooling and self-lubricating in the pump body, removes the leakage oil return pipeline, reduces the pump temperature, improves the heating state of friction, and achieves the purpose of prolonging the service life, but the flow participating in self-cooling only accounts for about 30-40% of the total flow, the cooling oil suctioned by the pump can not participate in self-cooling in the full flow, and it is impossible to automatically distribute the self-cooling flow according to the heat generated by each friction pair. The structure of the pump is shown in FIG. 2, and the liquid flowing condition in the pump is shown in FIG. 3.

SUMMARY

In order to overcome the above problems of the existing swashplate-type axial plunger pump, the present disclosure provides a swashplate-type axial plunger pump with multi-channel oil feed and full-flow self-cooling and double-end-face flow distribution. The present disclosure can distribute the self-cooling flow according to the heat productivity of the pump, and achieve the optimal self-cooling and self-lubricating effects with full flow participation, and achieve the purposes of reducing the pump temperature and prolonging the service life of the swashplate-type axial plunger pump.

The technical solution adopted by the present disclosure for solving the technical problem thereof is: a swashplate-type axial plunger pump with multi-channel oil feed and full-flow self-cooling and double-end-face flow distribution, comprising a pump body, a pump case, a cylinder block, a plunger, a thrust plate, a swashplate, an oil distribution plate and a slipper; wherein the pump body is mounted outside the pump case, and the cylinder block is mounted inside the pump case and is mounted on the pump body via the oil distribution plate; a first end of the plunger is mounted on the cylinder block, and a second end of the plunger is mounted on the thrust plate via the slipper; the thrust plate is mounted on the swashplate, and in a pump without a thrust plate, the second end of the plunger is directly mounted on the swashplate via the slipper; the cylinder block and the plunger, the oil distribution plate and the cylinder block, and the swashplate and the slipper respectively constitute a friction pair; the pump case is provided with one to three circular oil inlets; the circular oil inlets are disposed at an intermediate position at an upper end of the pump case; from top to bottom, cooling oil suctioned in by the plunger pump first cools the friction pair of the cylinder block and the plunger, then one part of the cooling oil passes through a gap between the pump case and the cylinder block and passes by the friction pair of the oil distribution plate and the cylinder block and enters a control chamber, and cools the friction pair of the oil distribution plate and the cylinder block; the other part of the cooling oil passes through a gap between the pump case and the cylinder block and passes by the friction pair of the slipper and the swashplate and enters the control chamber, and cools the friction pair of the slipper and the swashplate; the area of each circular oil inlet is greater than or equal to the sum of four plunger central holes and four cylinder block oil inlets, and three circular oil inlets are fed with oil simultaneously, or two circular oil inlets are fed with oil simultaneously, or one circular oil inlet is fed with oil, and unused circular oil inlets are blocked with screwed plugs. In addition, for the convenience of existing users, the oil inlet of the original pump is unchanged, and a special flow passage is arranged in the pump. Although the optimal effect cannot be achieved, about 30%-40% of the suctioned cold oil participates in self-cooling and self-lubricating, and a leakage oil return pipeline can still be removed.

The pump case is provided with one to five oil passing grooves at a position where a bearing is placed, and the total flow area of the oil passing grooves is greater than or equal to the sum of areas of four plunger central holes.

The pump case is provided with one to five oil inlet grooves at a position connected to the pump body on an oil suction side, and the total flow area of the oil inlet grooves is greater than or equal to the sum of areas of four cylinder block oil inlets.

The pump body is provided with one to five oil inlet grooves corresponding to the pump case at a position connected to the pump case, and the total flow area of the oil inlet grooves is greater than or equal to the sum of areas of four cylinder block oil inlets.

The oil inlet side of the swashplate is provided with one to five oil inlet slotted holes at the running track of the slipper, and the total flow area of the oil inlet slotted holes is greater than or equal to the sum of areas of four plunger central holes.

The thrust plate is provided with a corresponding oil inlet slotted hole at a position corresponding to the swashplate, and communicates through a groove at a contact side with the slipper; in a pump without a thrust plate, the swashplate communicates through a groove at the running track of the slipper on an oil suction side of the contact surface with the slipper.

The oil distribution plate is provided with sloped openings on the contact surface with the pump body at the position corresponding to the pump body on an oil suction side, the number of the sloped openings is the same as the number of the openings of the pump body, and the sloped openings is closable when the overflow area between the oil distribution plate and the pump case is sufficiently large.

The beneficial effects of the present disclosure are that after the cooling oil or normal-temperature lubricating oil suctioned by the plunger pump of the present disclosure enters through the middle of the pump case, the three friction pairs are directly cooled, and because the two provided channels have resistance to the oil, and the resistance can change the flow rate, when the liquid resistance of the channels is changed according to the amount of heat generated by each friction pair, the liquid resistance of the two channels and the cooling flow form a proportional relation. By means of the method that the liquid resistance is proportional to the heat productivity, the self-cooling flow can be distributed according to the heat productivity of the pump, the optimal self-cooling and self-lubricating effects with full flow participation are achieved, meanwhile, a leakage oil return pipeline can be removed, and finally the purposes of reducing the temperature of the pump and prolonging the service life of the pump are achieved.

In the above drawings, 1. Swashplate-type axial plunger pump with multi-channel oil feed and full-flow self-cooling and double-end-face flow distribution (half-shaft); 1-1. Circular oil inlet; 1-2. Pump body; 1-3. Pump case; 1-4. Thrust plate; 1-5. Swashplate; 1-6. Variable case; 1-7. Oil distribution plate; 1-3-2. Oil inlet groove; 1-3-3. Oil passing groove; 1-2-1. Oil inlet groove; 1-5-1. Oil inlet slotted hole; 1-4-1. Oil inlet slotted hole; 1-7-1 Sloped opening; 2. Swashplate-type axial plunger pump with multi-channel oil feed and full-flow self-cooling and double-end-face flow distribution (through shaft I); 2-1. Circular oil inlet; 2-2. Pump body; 2-3. Pump case; 2-4. Thrust Plate; 2-5. Swashplate; 2-2-1. Oil inlet groove; 2-3-2. Oil inlet groove; 2-5-1. Oil inlet slotted hole; 3. Swashplate-type axial plunger pump with multi-channel oil feed and full-flow self-cooling and double-end-face flow distribution (through shaft II); 3-1. Circular oil inlet; 3-2. Pump body; 3-3. Pump case; 3-4. Thrust plate; 3-5. Swashplate; 3-3-2. Oil inlet groove; 3-5-1. Oil inlet slotted hole; 4. Swashplate-type axial plunger pump with multi-channel oil feed and full-flow self-cooling and double-end-face flow distribution (through shaft III); 4-1. Circular oil inlet; 4-2. Pump body; 4-3. Pump case; 4-4. Thrust plate; 4-5. Swashplate; 4-5-1. Oil inlet slotted hole.

DETAILED DESCRIPTION

Example 1

Figure 1:
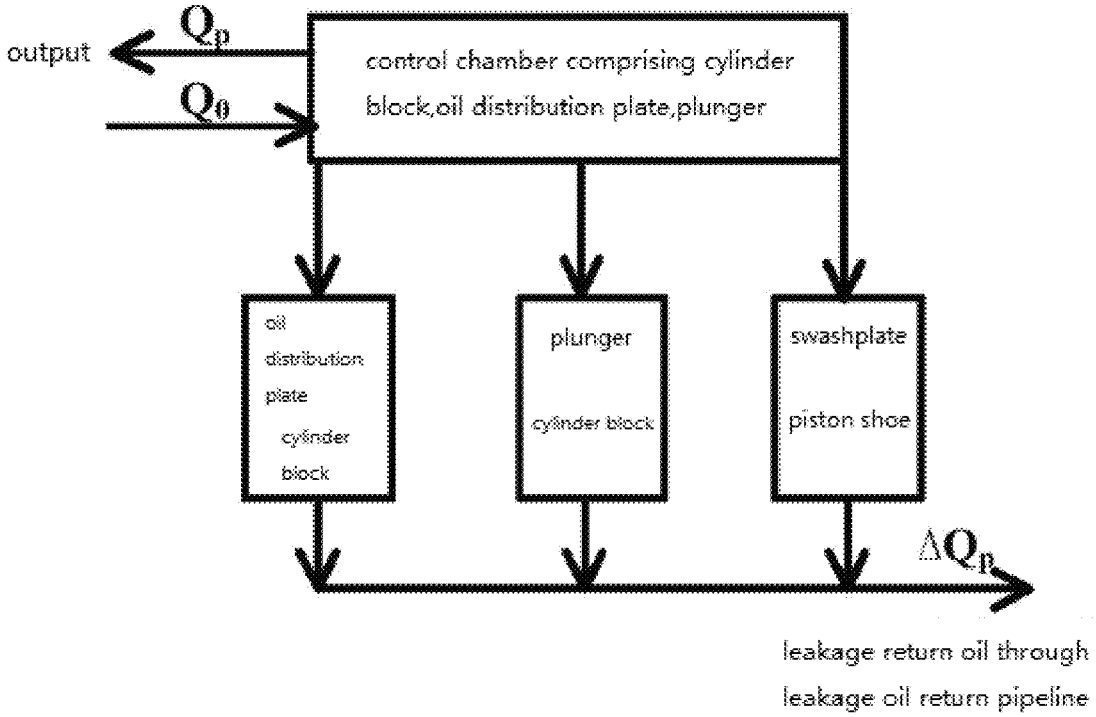
Fig. 1 Prior Art
FIG. 1 shows the liquid flow in a swashplate-type axial plunger pump in the prior art.
Figure 2:
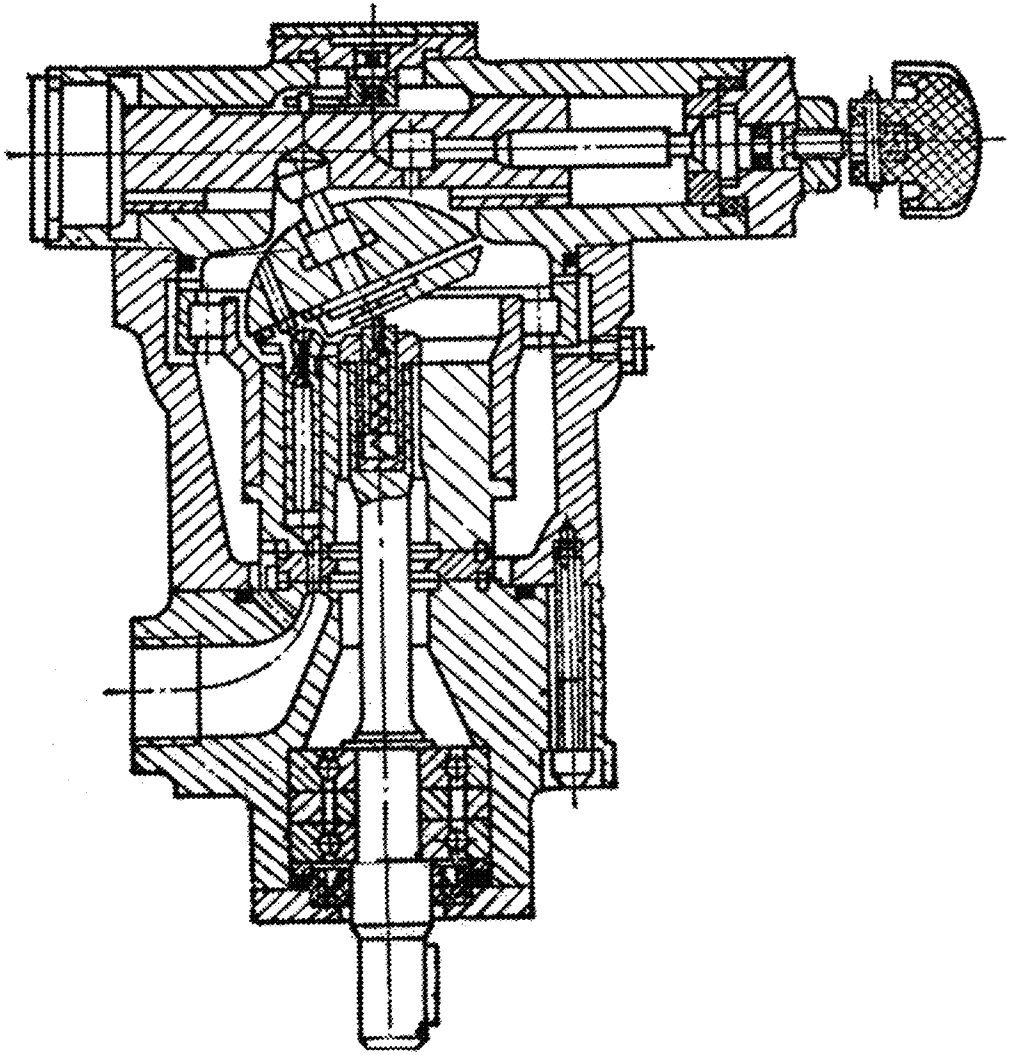
Fig. 2 Prior Art
FIG. 2 is a schematic view of the structure of an axial plunger pump with double-end-face flow distribution in the prior art.
Figure 3:
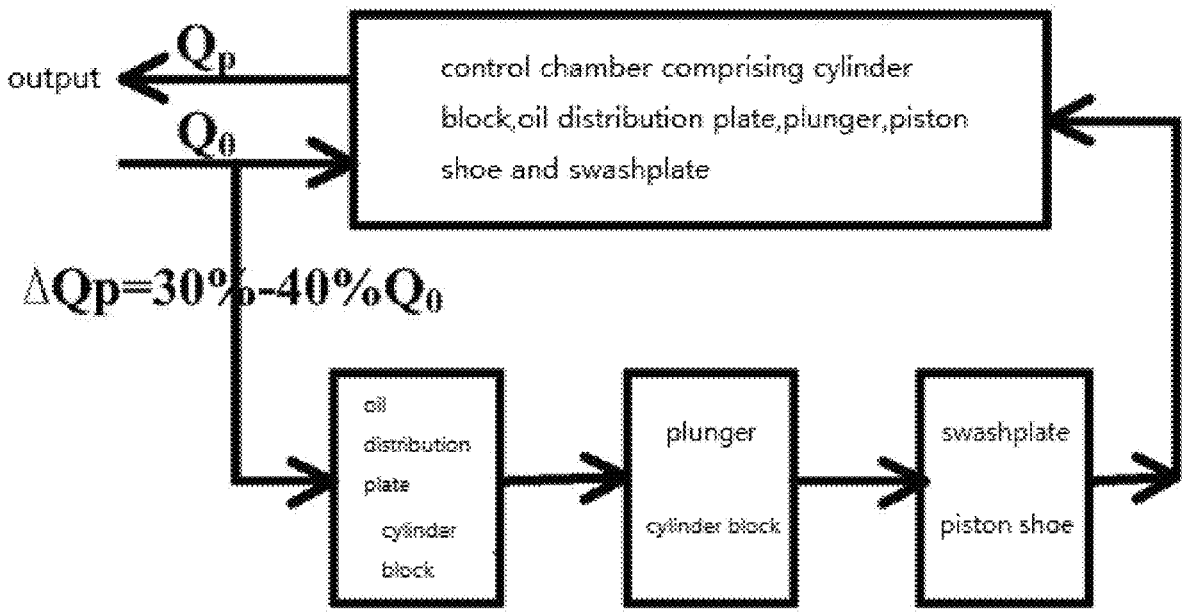
Fig. 3 Prior Art
FIG. 3 shows the liquid flow in the axial plunger pump with double-end-face flow distribution in the prior art.
Figure 4:
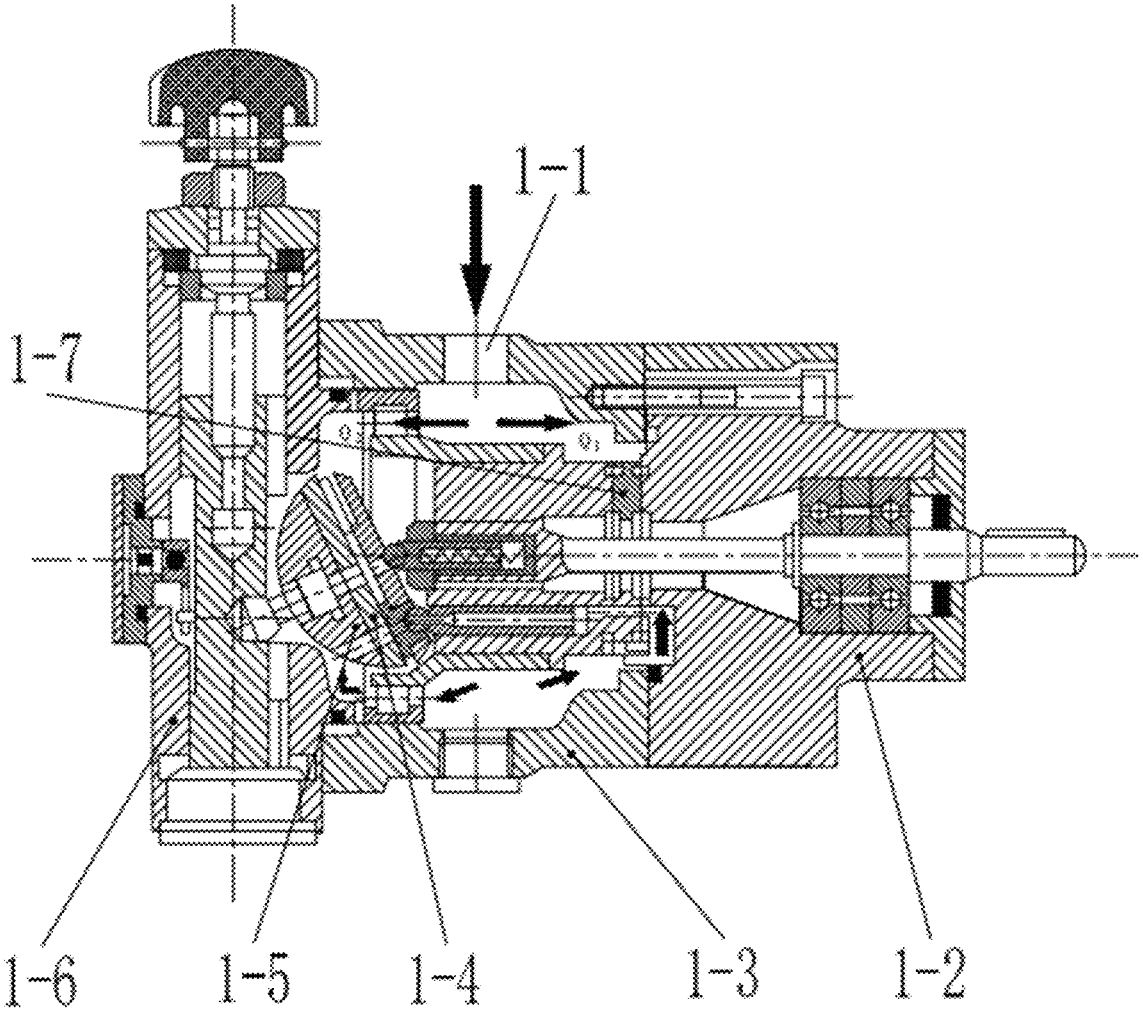
FIG. 4 is a half-shaft schematic view of the structure of the swashplate-type axial plunger pump with multi-channel oil feed and full-flow self-cooling and double-end-face flow distribution of the present disclosure.
Figure 5:
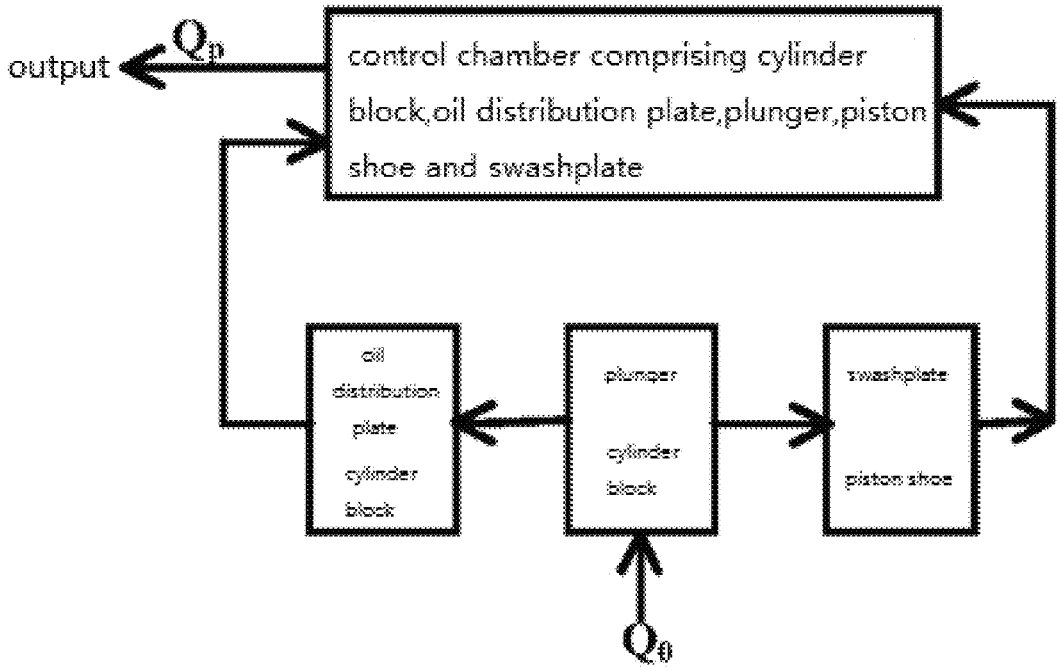
FIG. 5 is a schematic view of the liquid flow in the swashplate-type axial plunger pump with multi-channel oil feed and full-flow self-cooling and double-end-face flow distribution of the present disclosure.
Figure 6:
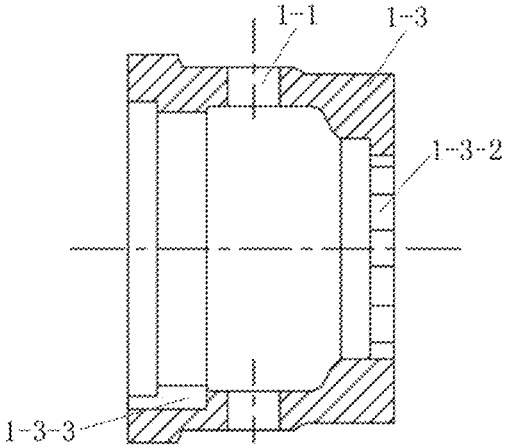
FIG. 6 is a half-shaft sectional view of the pump case.
Figure 7:
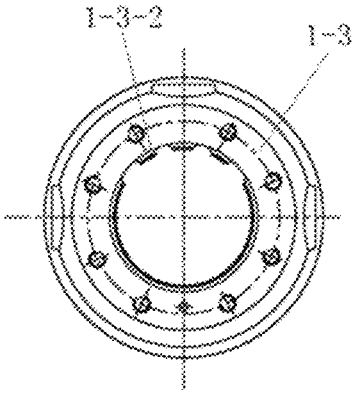
FIG. 7 is a left side view of the pump case.
Figure 8:
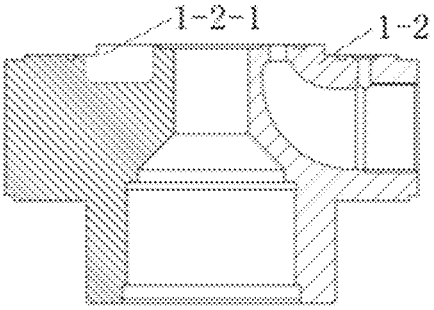
FIG. 8 is a half-shaft sectional view of the pump body.
Figure 9:
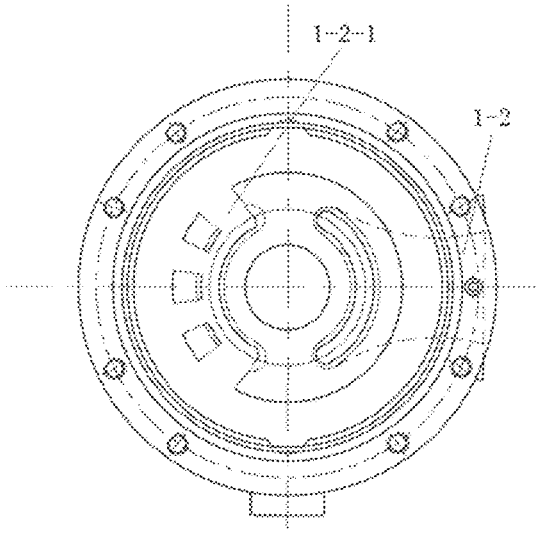
FIG. 9 is a top view of the pump body.
Figure 10:
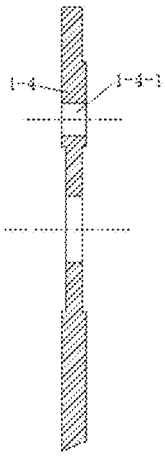
FIG. 10 is an A-A sectional view of the thrust plate.
Figure 11:
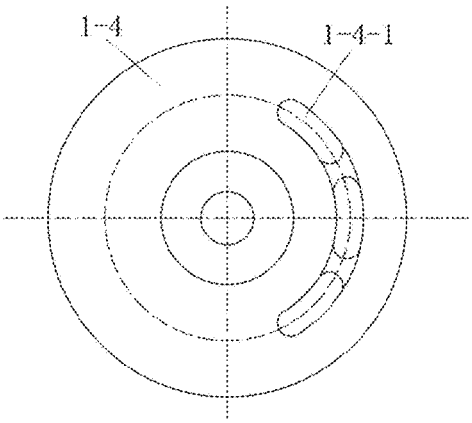
FIG. 11 is a front view of the thrust plate.
Figure 12:
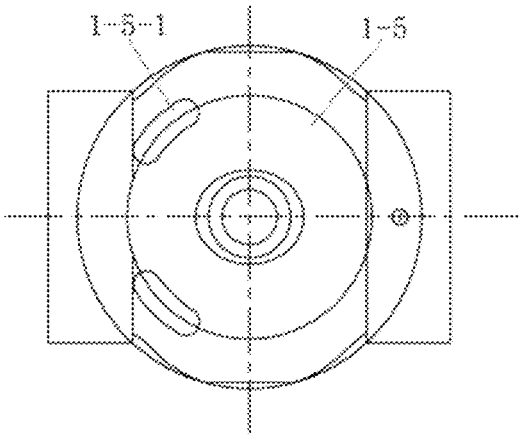
FIG. 12 is a front view of the swashplate.
Figure 13:
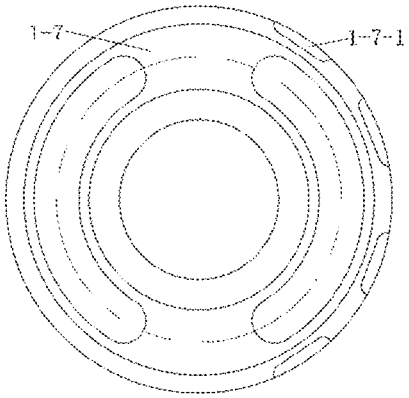
FIG. 13 is a front view of the oil distribution plate (half-shaft)

FIG. 4 is a first embodiment of the disclosure of the present disclosure, which shows the (half-shaft) schematic view of the structure of the swashplate-type axial plunger pump with multi-channel oil feed and full-flow self-cooling and double-end-face flow distribution, and the internal liquid flow in the pump body is shown in FIG. 5. The present disclosure is developed on the basis of an axial plunger pump with double-end-face flow distribution. One to three circular oil inlets 1-1 are provided on the middle circumference of the pump case 1-3. The area of each circular oil inlet 1-1 is greater than or equal to the sum of the areas of four plunger center holes plus the areas of four cylinder block oil inlets. All three circular oil inlets may be fed with oil simultaneously, or two circular oil inlets may be fed with oil simultaneously. This embodiment adopts one circular oil inlet 1-1. The unused oil inlets are blocked with screwed plugs. One to five oil inlet grooves 1-3-2 are provided on the oil suction side at the position where the pump case 1-3 is connected to the pump body 1-2, and the total flow area thereof should be greater than or equal to the total area of four cylinder block oil inlets (as shown in FIG. 6). The pump body 1-2 is provided with one to five oil inlet grooves 1-2-1 corresponding to the pump case 1-3 at a position connected to the pump case 1-3, and the total flow area thereof should be greater than or equal to the sum of the areas of four cylinder block oil inlets (see FIGS. 8 and 9). One to five oil passing grooves 1-3-3 are provided in the pump case 1-3 where the bearing is mounted, and the flow area of the three oil passing grooves 1-3-3 should be greater than or equal to the sum of the areas of four plunger central holes (see FIG. 6). One to five oil inlet slotted holes 1-5-1 are provided at the running track of the slipper on the oil inlet side of the swashplate 1-5, and the flow area of the oil inlet slotted holes 1-5-1 should be greater than or equal to the sum of the areas of four plunger central holes (see FIG. 12). Corresponding oil inlets 1-4-1 are provided on the thrust plate 1-4 at the position corresponding to the swashplate 3, and communicates through a groove at the contact side with the slipper (see FIGS. 10 and 11), and the oil distribution plate 1-7 is provided with sloped openings 1-7-1 on the contact surface with the pump body at the position corresponding to the pump body on the oil suction side (FIG. 13).

In a pump without a thrust plate, the swashplate communicates through a groove at the running track of the slipper on an oil suction side. In the pump, the plunger center hole, the slipper center hole, and the connection between the variable case and the pump case are provided with oil inlet channels to ensure the smooth flow channel of double-end-face flow distribution.

In the present embodiment, all the suctioned cooling oil is involved in the cooling of the pump to achieve a completely self-cooling effect (see FIG. 5). After the suctioned cooling oil enters through the circular oil inlet 1-1 of the pump case 1-3, the suctioned cooling oil enters the pump just facing the pair of the cylinder block and the plunger at this time, and this part of the cooling oil directly cools the friction pair of the cylinder block and the plunger, thereby improving the heating conditions of the friction pair of the cylinder block and the plunger, and achieving the effect of self-cooling and self-lubricating. After entering the pump case 1-3, one part of the cooling oil passes through the inner channel of the pump case, and passes by the swashplate and enters the plunger cavity through the slipper, and this part of cooling oil improves the heating condition of the friction pair of the slipper and the swashplate. The other part of the cooling oil passes through the channel provided in the pump case 1-3 and passes through the gap between the pump case 1-3 and the cylinder block 1-2, and passes by the friction pair of the oil distribution plate and the cylinder block, which also improves and solves the heating condition hereof. Because the two provided channels have resistance to the oil, and the resistance can change the flow rate. When the liquid resistance of the channels is changed according to the amount of heat generated by each friction pair, the liquid resistance of the two channels and the cooling flow form a proportional relation. By means of the method that the liquid resistance is proportional to the heat productivity, the self-cooling flow can be distributed according to the heat productivity of the pump, the optimal self-cooling and self-lubricating effects with full flow participation are achieved, meanwhile, a leakage oil return pipeline can be removed, and finally the purposes of reducing the temperature of the pump and prolonging the service life of the pump are achieved.

Example 2

Figure 14:
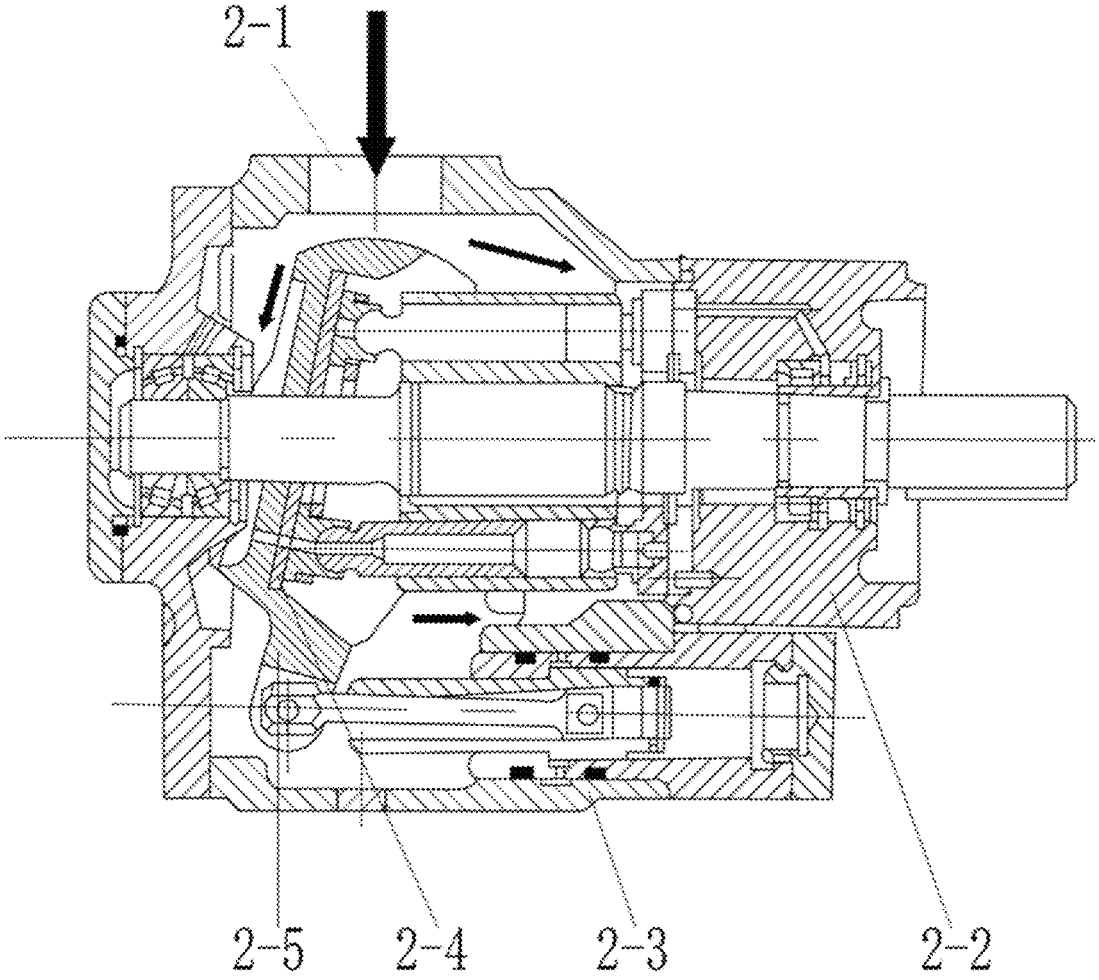
FIG. 14 is a schematic view of the structure of the swashplate-type axial plunger pump with multi-channel oil feed and full-flow self-cooling and double-end-face flow distribution (through shaft I)
Figure 15:
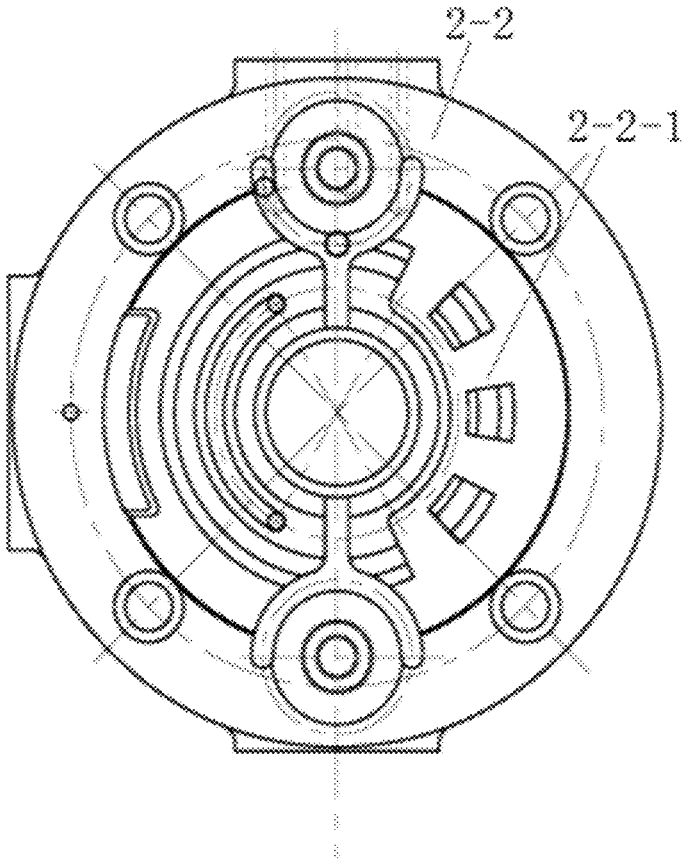
FIG. 15 is a front view of the pump body (through shaft I)
Figure 16:
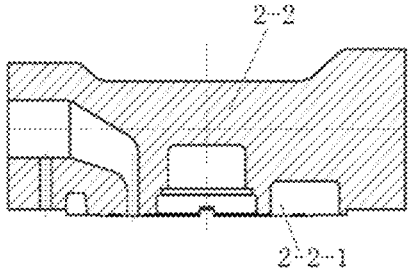
FIG. 16 is a sectional view of the pump body (through shaft I)
Figure 17:
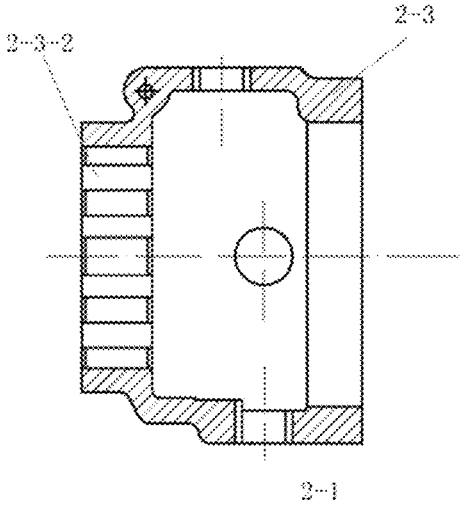
FIG. 17 is a sectional view of the pump case (through shaft I)
Figure 18:
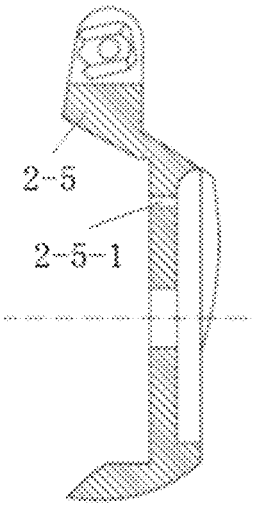
FIG. 18 is a sectional view of the swashplate (through shaft I)

FIG. 14 is a second embodiment of the disclosure of the present disclosure, which shows the schematic view of the structure of the swashplate-type axial plunger pump with multi-channel oil feed and full-flow self-cooling and double-end-face flow distribution (through shaft I), and the internal liquid flow in the pump body is shown in FIG. 14. The present disclosure is developed on the basis of an axial plunger pump with double-end-face flow distribution. One to three circular oil inlets 2-1 are provided on the middle circumference of the pump case 2-3. The area of each circular oil inlet 2-1 is greater than or equal to the sum of the areas of four plunger center holes plus the areas of four cylinder block oil inlets. All three circular oil inlets 2-1 may be fed with oil simultaneously, or two circular oil inlets 2-1 may be fed with oil simultaneously. This embodiment adopts one circular oil inlet 2-1. The unused oil inlets are blocked with screwed plugs. One to five oil inlet grooves 2-3-2 are provided on the oil suction side at the position where the pump case 2-3 is connected to the pump body 2-2, and the total flow area thereof should be greater than or equal to the total area of four cylinder block oil inlets (as shown in FIG. 17). One to five oil inlet grooves 2-2-1 are provided on the pump body 2-2 at a position connected to the pump case 2-3 on the oil suction side (see FIGS. 15 and 16). One to five oil inlet slotted holes 2-5-1 are provided at the running track of the slipper on the oil inlet side of the swashplate 2-5, and the flow area of the oil inlet slotted holes 2-5-1 should be greater than or equal to the sum of the areas of four plunger central holes (see FIG. 18).

In a pump without a thrust plate, the swashplate communicates through a groove at the running track of the slipper on an oil suction side. In the pump, the plunger center hole, the slipper center hole, and the connection between the variable case and the pump case are provided with oil inlet channels to ensure the smooth flow channel of double-end-face flow distribution.

In the present embodiment, all the suctioned cooling oil is involved in the cooling of the pump to achieve a completely self-cooling effect (see FIG. 14). After the suctioned cooling oil enters through the circular oil inlet 2-1 of the pump case 2-3, the suctioned cooling oil enters the pump just facing the pair of the cylinder block and the plunger at this time, and this part of the cooling oil directly cools the friction pair of the cylinder block and the plunger, thereby improving the heating conditions of the friction pair of the cylinder block and the plunger, and achieving the effect of self-cooling and self-lubricating. After entering the pump case 2-3, one part of the cooling oil passes through the inner channel of the pump case, and passes by the swashplate and enters the plunger cavity through the slipper, and this part of cooling oil improves the heating condition of the friction pair of the slipper and the swashplate. The other part of the cooling oil passes through the channel provided in the pump case 2-3 and passes through the gap between the pump case 2-3 and the cylinder block 2-2, and passes by the friction pair of the oil distribution plate and the cylinder block, which also improves and solves the heating condition hereof. Because the two provided channels have resistance to the oil, and the resistance can change the flow rate. When the liquid resistance of the channels is changed according to the amount of heat generated by each friction pair, the liquid resistance of the two channels and the cooling flow form a proportional relation. By means of the method that the liquid resistance is proportional to the heat productivity, the self-cooling flow can be distributed according to the heat productivity of the pump, the optimal self-cooling and self-lubricating effects with full flow participation are achieved, meanwhile, a leakage oil return pipeline can be removed, and finally the purposes of reducing the temperature of the pump and prolonging the service life of the pump are achieved.

Example 3

Figure 19:
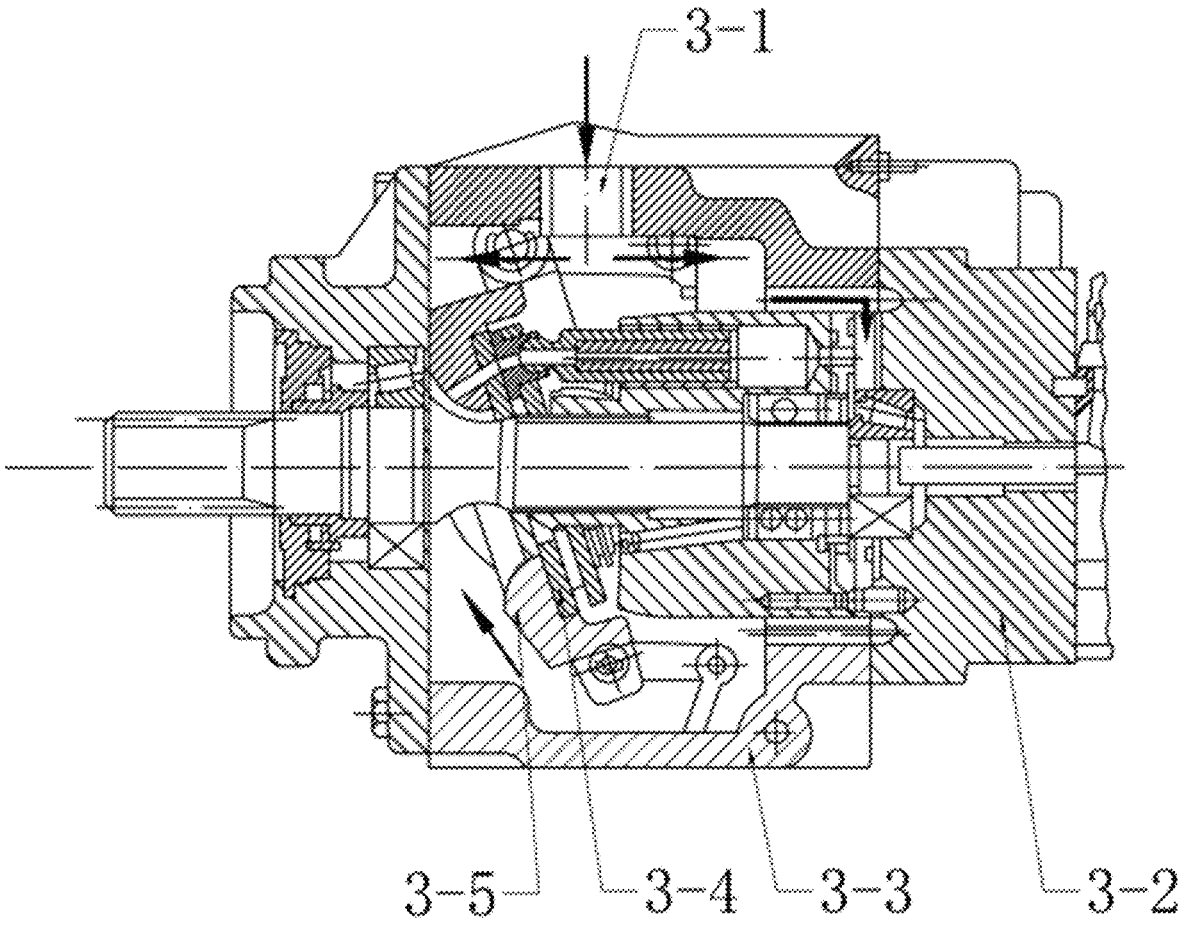
FIG. 19 is a schematic view of the structure of the swashplate-type axial plunger pump with multi-channel oil feed and full-flow self-cooling and double-end-face flow distribution (through shaft II)
Figure 20:
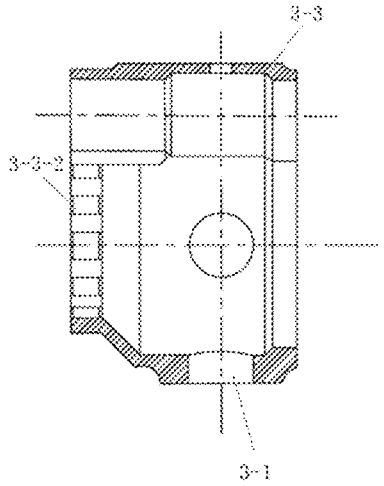
FIG. 20 is a sectional view of the pump case (through shaft II)
Figure 21:
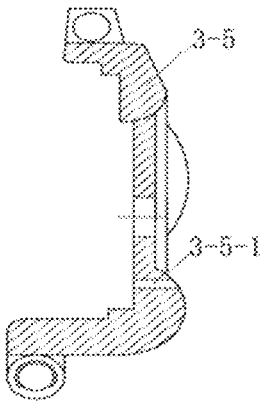
FIG. 21 is a sectional view of the swashplate (through shaft II)

FIG. 19 is a third embodiment of the disclosure of the present disclosure, which shows the schematic view of the structure of the swashplate-type axial plunger pump with multi-channel oil feed and full-flow self-cooling and double-end-face flow distribution (through shaft II). The present disclosure is developed on the basis of an axial plunger pump with double-end-face flow distribution. One to three circular oil inlets 3-1 are provided on the middle circumference of the pump case 3-3. The area of each circular oil inlet 3-1 is greater than or equal to the sum of the areas of four plunger center holes plus the areas of four cylinder block oil inlets. All circular oil inlets 3-1 may be fed with oil simultaneously, or two circular oil inlets 3-1 may be fed with oil simultaneously, or only one circular oil inlet 3-1 is opened. This embodiment adopts one circular oil inlet 3-1. The unused oil inlets are blocked with screwed plugs. One to five oil inlet grooves 3-3-2 are provided on the oil suction side at the position where the pump case 3-3 is connected to the pump body 3-2, and the total flow area thereof should be greater than or equal to the total area of four cylinder block oil inlets (as shown in FIG. 20). One to five oil inlet slotted holes 3-5-1 are provided at the running track of the slipper on the oil inlet side of the swashplate 3-5, and the flow area of the oil inlet slotted holes 3-5-1 should be greater than or equal to the sum of the areas of four plunger central holes (see FIG. 21).

In a pump without a thrust plate, the swashplate communicates through a groove at the running track of the slipper on an oil suction side. In the pump, oil inlet grooves are provided at a corresponding position on the oil absorption side between the pump body and the pump case, the plunger center hole, the slipper center hole, and the connection between the variable case and the pump case are provided with oil inlet channels to ensure the smooth flow channel of double-end-face flow distribution.

In the present embodiment, all the suctioned cooling oil is involved in the cooling of the pump to achieve a completely self-cooling effect (see FIG. 19). After the suctioned cooling oil enters through the circular oil inlet 3-1 of the pump case 3-3, the suctioned cooling oil enters the pump just facing the pair of the cylinder block and the plunger at this time, and this part of the cooling oil directly cools the friction pair of the cylinder block and the plunger, thereby improving the heating conditions of the friction pair of the cylinder block and the plunger, and achieving the effect of self-cooling and self-lubricating. After entering the pump case 3-3, one part of the cooling oil passes through the inner channel of the pump case, and passes by the swashplate and enters the plunger cavity through the slipper, and this part of cooling oil improves the heating condition of the friction pair of the slipper and the swashplate. The other part of the cooling oil passes through the channel provided in the pump case 3-3 and passes through the gap between the pump case 3-3 and the cylinder block 3-2, and passes by the friction pair of the oil distribution plate and the cylinder block, which also improves and solves the heating condition hereof. Because the two provided channels have resistance to the oil, and the resistance can change the flow rate. When the liquid resistance of the channels is changed according to the amount of heat generated by each friction pair, the liquid resistance of the two channels and the cooling flow form a proportional relation. By means of the method that the liquid resistance is proportional to the heat productivity, the self-cooling flow can be distributed according to the heat productivity of the pump, the optimal self-cooling and self-lubricating effects with full flow participation are achieved, meanwhile, a leakage oil return pipeline can be removed, and finally the purposes of reducing the temperature of the pump and prolonging the service life of the pump are achieved.

Example 4

Figure 22:
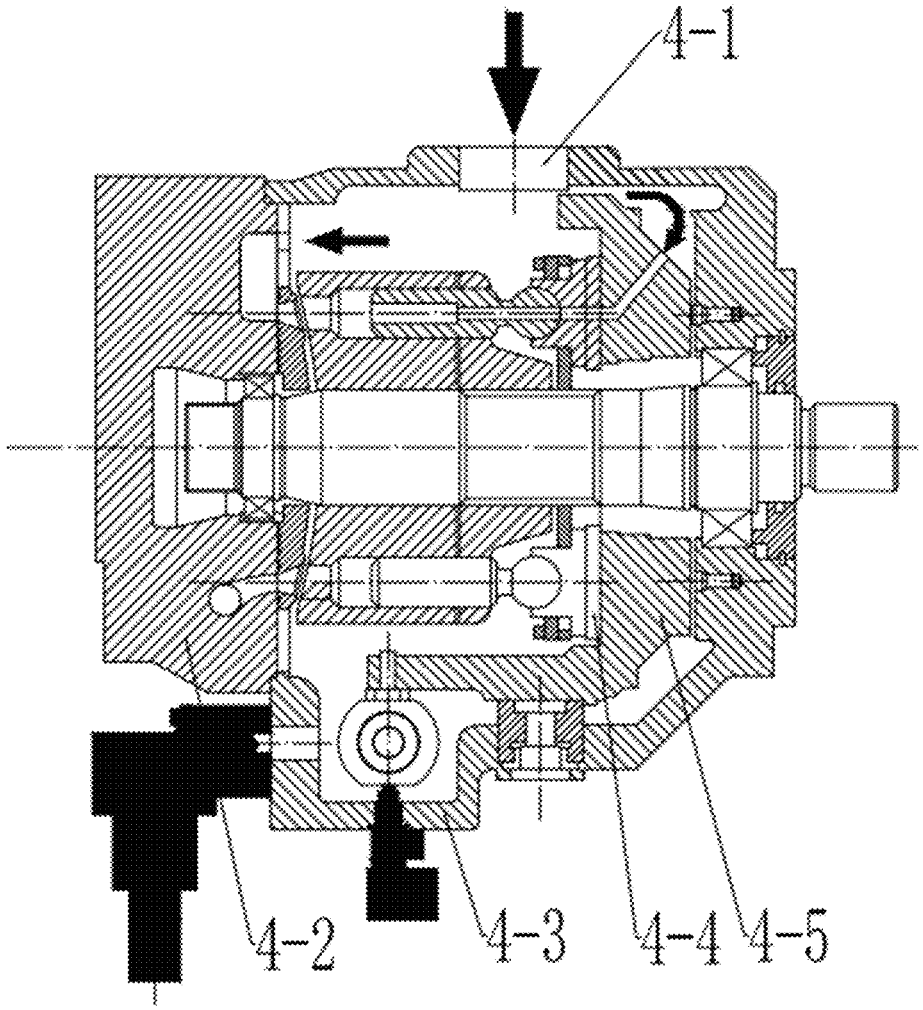
FIG. 22 is a schematic view of the structure of the swashplate-type axial plunger pump with multi-channel oil feed and full-flow self-cooling and double-end-face flow distribution (through shaft III)
Figure 23:
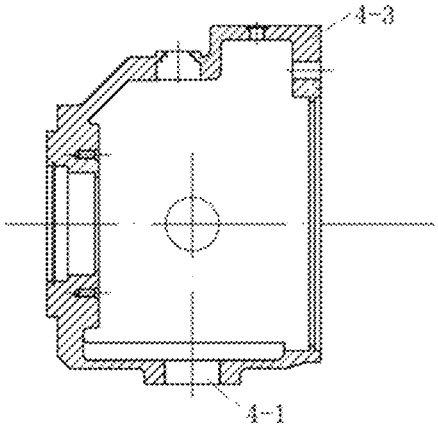
FIG. 23 is a sectional view of the pump case (through shaft III)
Figure 24:
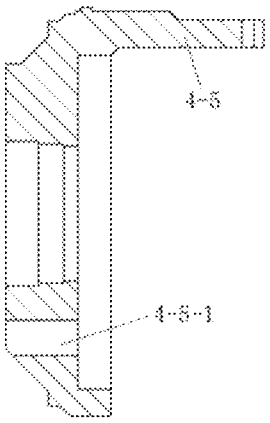
FIG. 24 is a sectional view of the swashplate (through shaft III).

FIG. 22 is a fourth embodiment of the disclosure of the present disclosure, which shows the schematic view of the structure of the swashplate-type axial plunger pump with multi-channel oil feed and full-flow self-cooling and double-end-face flow distribution (through shaft III). One to three circular oil inlets 4-1 are provided on the middle circumference of the pump case 4-3. The area of each circular oil inlet 4-1 is greater than or equal to the sum of the areas of four plunger center holes plus the areas of four cylinder block oil inlets. All circular oil inlets 4-1 may be fed with oil simultaneously, or two circular oil inlets 4-1 may be fed with oil simultaneously, or only one circular oil inlet 4-1 is opened. This embodiment adopts one circular oil inlet 4-1. The unused oil inlets are blocked with screwed plugs. One to five oil inlet slotted holes 4-5-1 are provided at the running track of the slipper on the oil inlet side of the swashplate 4-5, and the flow area of the oil inlet slotted holes 4-5-1 should be greater than or equal to the sum of the areas of four plunger central holes (see FIG. 24).

In a pump without a thrust plate, the swashplate communicates through a groove at the running track of the slipper on an oil suction side. In the pump, oil inlet grooves are provided at a corresponding position on the oil absorption side between the pump body and the pump case, the plunger center hole, the slipper center hole, and the connection between the variable case and the pump case are provided with oil inlet channels to ensure the smooth flow channel of double-end-face flow distribution.

In the present embodiment, all the suctioned cooling oil is involved in the cooling of the pump to achieve a completely self-cooling effect (see FIG. 22). After the suctioned cooling oil enters through the circular oil inlet 4-1 of the pump case 4-3, the suctioned cooling oil enters the pump just facing the pair of the cylinder block and the plunger at this time, and this part of the cooling oil directly cools the friction pair of the cylinder block and the plunger, thereby improving the heating conditions of the friction pair of the cylinder block and the plunger, and achieving the effect of self-cooling and self-lubricating. After entering the pump case 4-3, one part of the cooling oil passes through the inner channel of the pump case, and passes by the swashplate and enters the plunger cavity through the slipper, and this part of cooling oil improves the heating condition of the friction pair of the slipper and the swashplate. The other part of the cooling oil passes through the channel provided in the pump case 4-3 and passes through the gap between the pump case 4-3 and the cylinder block 4-2, and passes by the friction pair of the oil distribution plate and the cylinder block, which also improves and solves the heating condition hereof. Because the two provided channels have resistance to the oil, and the resistance can change the flow rate. When the liquid resistance of the channels is changed according to the amount of heat generated by each friction pair, the liquid resistance of the two channels and the cooling flow form a proportional relation. By means of the method that the liquid resistance is proportional to the heat productivity, the self-cooling flow can be distributed according to the heat productivity of the pump, the optimal self-cooling and self-lubricating effects with full flow participation are achieved, meanwhile, a leakage oil return pipeline can be removed, and finally the purposes of reducing the temperature of the pump and prolonging the service life of the pump are achieved.

The invention claimed is:

1. A swashplate-type axial plunger pump with multi-channel oil feed and full-flow self-cooling and double-end-face flow distribution, comprising a pump body, a pump case, a cylinder block, a plunger, a thrust plate, a swashplate, an oil distribution plate and a slipper; wherein the pump body is mounted outside the pump case, and the cylinder block is mounted inside the pump case and is mounted on the pump body via the oil distribution plate; a first end of the plunger is mounted on the cylinder block, and a second end of the plunger is mounted on the thrust plate via the slipper; the thrust plate is mounted on the swashplate, and the cylinder block and the plunger, the oil distribution plate and the cylinder block, and the swashplate and the slipper respectively constitute a friction pair; the pump case is provided with one to three circular oil inlets; the circular oil inlets are disposed at an intermediate position at an upper end of the pump case; from top to bottom, cooling oil suctioned in by the plunger pump first cools the friction pair of the cylinder block and the plunger, then one part of the cooling oil passes through a gap between the pump case and the cylinder block and passes by the friction pair of the oil distribution plate and the cylinder block and enters a control chamber, and cools the friction pair of the oil distribution plate and the cylinder block; an other part of the cooling oil passes through a gap between the pump case and the cylinder block and passes by the friction pair of the slipper and the swashplate and enters the control chamber, and cools the friction pair of the slipper and the swashplate; the area of each circular oil inlet is greater than or equal to a sum of four plunger central holes and four cylinder block oil inlets, and three circular oil inlets are fed with oil simultaneously, or two circular oil inlets are fed with oil simultaneously, or one circular oil inlet is fed with oil, and unused circular oil inlets are blocked with screwed plugs.

2. The swashplate-type axial plunger pump with multi-channel oil feed and full-flow self-cooling and double-end-face flow distribution according to claim 1, wherein the pump case is provided with one to five oil passing grooves at a position where a bearing is placed, and a total flow area of the oil passing grooves is greater than or equal to a sum of areas of four plunger central holes.

3. The swashplate-type axial plunger pump with multi-channel oil feed and full-flow self-cooling and double-end-face flow distribution according to claim 1, wherein the pump case is provided with one to five oil inlet grooves at a position connected to the pump body on an oil suction side, and a total flow area of the oil inlet grooves is greater than or equal to a sum of areas of four cylinder block oil inlets.

4. The swashplate-type axial plunger pump with multi-channel oil feed and full-flow self-cooling and double-end-face flow distribution according to claim 1, wherein the pump body is provided with one to five oil inlet grooves corresponding to the pump case at a position connected to the pump case, and a total flow area of the oil inlet grooves is greater than or equal to a sum of areas of four cylinder block oil inlets.

5. The swashplate-type axial plunger pump with multi-channel oil feed and full-flow self-cooling and double-end-face flow distribution according to claim 1, wherein an oil inlet side of the swashplate is provided with one to five oil inlet slotted holes at a running track of the slipper, and a total flow area of the oil inlet slotted holes is greater than or equal to a sum of areas of four plunger central holes.

6. The swashplate-type axial plunger pump with multi-channel oil feed and full-flow self-cooling and double-end-face flow distribution according to claim 1, wherein the thrust plate is provided with a corresponding oil inlet slotted hole at a position corresponding to the swashplate, and communicates through a groove at a contact side with the slipper.

7. The swashplate-type axial plunger pump with multi-channel oil feed and full-flow self-cooling and double-end-face flow distribution according to claim 1, wherein the oil distribution plate is provided with sloped openings on the contact surface with the pump body at a position corresponding to the pump body on an oil suction side, the number of the sloped openings is the same as the number of the openings of the pump body, and the sloped openings is closable when an overflow area between the oil distribution plate and the pump case is sufficiently large.

8. The swashplate-type axial plunger pump with multi-channel oil feed and full-flow self-cooling and double-end-face flow distribution according to claim 1, wherein the plunger center hole, a slipper center hole, and a connection between a variable case and the pump case are provided with oil inlet channels.

* * * * *